United States Patent [19]

Nakatsuka et al.

[11] 4,436,074

[45] Mar. 13, 1984

[54] METHOD AND APPARATUS FOR CONTROLLING THE FUEL INJECTION IN INTERNAL COMBUSTION ENGINE

[75] Inventors: Hirotaka Nakatsuka, Kariya; Toshiaki Mizuno, Nagoya; Hisamitsu Yamazoe, Kariya; Hiroki Matsuoka, Susono, all of Japan

[73] Assignees: Nippondenso Co., Ltd., Kariya; Toyota Jidosha Kogyo Kabushiki Kaisha, Touota, both of Japan

[21] Appl. No.: 388,654

[22] Filed: Jun. 15, 1982

[30] Foreign Application Priority Data

Jun. 17, 1981 [JP] Japan ..... 56-92110

[51] Int. Cl.[3] ..... F02B 3/00; F02B 33/00

[52] U.S. Cl. ..... 123/492; 123/494; 123/493

[58] Field of Search ..... 123/492, 493, 494

[56] References Cited

U.S. PATENT DOCUMENTS

| | | | |
|---|---|---|---|
| 4,126,107 | 11/1978 | Harada | 123/492 |
| 4,148,283 | 4/1979 | Harada | 123/493 |
| 4,221,191 | 9/1980 | Asano | 123/492 |
| 4,257,377 | 3/1981 | Kinugawa | 123/492 |
| 4,266,522 | 5/1981 | Williams | 123/492 |
| 4,326,488 | 4/1982 | Herth | 123/492 |

*Primary Examiner*—Ronald B. Cox

*Attorney, Agent, or Firm*—Cushman, Darby & Cushman

[57] ABSTRACT

In a method for controlling the fuel injection in an internal combustion engine by using an electronic control device for triggering the fuel increase to the engine acceleration state, the fuel increase is prohibited or modified during gear change operations of the automobile driven by the engine corresponding to the detection of the state where the rate of change of the ratio between the intake air amount is algebraically less than a predetermined value, or to the output signal of a clutch switch.

5 Claims, 8 Drawing Figures

(1) ACCELERATION (2) FUEL AMOUNT INCREASE (3) CHANGE GEAR (4) PROHIBITION OF FUEL AMOUNT INCREASE (1) ACCELERATION (2) FUEL AMOUNT INCREASE (3) CHANGE GEAR (4) MODIFICATION OF FUEL AMOUNT INCREASE

METHOD AND APPARATUS FOR CONTROLLING THE FUEL INJECTION IN INTERNAL COMBUSTION ENGINE

FIELD OF THE INVENTION

The present invention relates to a method and an apparatus for controlling the fuel injection in an internal combustion engine. The method and apparatus can be used for the internal combustion engine of an automobile.

BACKGROUND OF THE INVENTION

In a prior art method for controlling the fuel injection in an internal combustion engine, amount of fuel was increased when a signal representing the engine acceleration state, for example, the rate of change (ΔQ/N) of the ratio (Q/N) between the intake air amount (Q) and the engine rotational speed (N), rose above a predetermined value. This increase was effected according to a fuel increase rate determined by a detected variable, such as the coolant water temperature. Increased fuel injection has been considered necessary, because engine acceleration, causes an increase in the intake air and hence, a temporary shortage of fuel supplied to the engine. This has a detrimental effect on the engine drivability.

The above prior art method, however, has the disadvantage in that when changing gears to shift speeds in a manual transmission automobile, an unnecessary increase of fuel takes place, causing the air-fuel ratio to become excessively rich and, hence, having detrimental effect on engine drivability.

This unnecessary increase of fuel takes place because the rate of change (ΔQ/N) of the ratio (Q/N) changes during gear change in the same way as during engine acceleration. That is, there is no discrimination made between engine acceleration and a gear change operation.

SUMMARY OF THE INVENTION

It is the object of the present invention to provide an improved method and apparatus for controlling the fuel injection in an internal combustion engine, wherein the above problem in the prior art is solved, i.e., the unnecessary increase of fuel is prevented, thereby improving fuel consumption efficiency and engine drivability.

According to the fundamental aspect of the present invention, there is provided a method for controlling the fuel injection in an internal combustion engine, wherein a detected predetermined variable representing the engine acceleration state is used as the signal triggering the fuel increase, characterized in that said increase of fuel is prohibited or modified during gear change operations of the automobile driven by the engine.

PREFERRED EMBODIMENTS OF THE INVENTION

Figure 1:
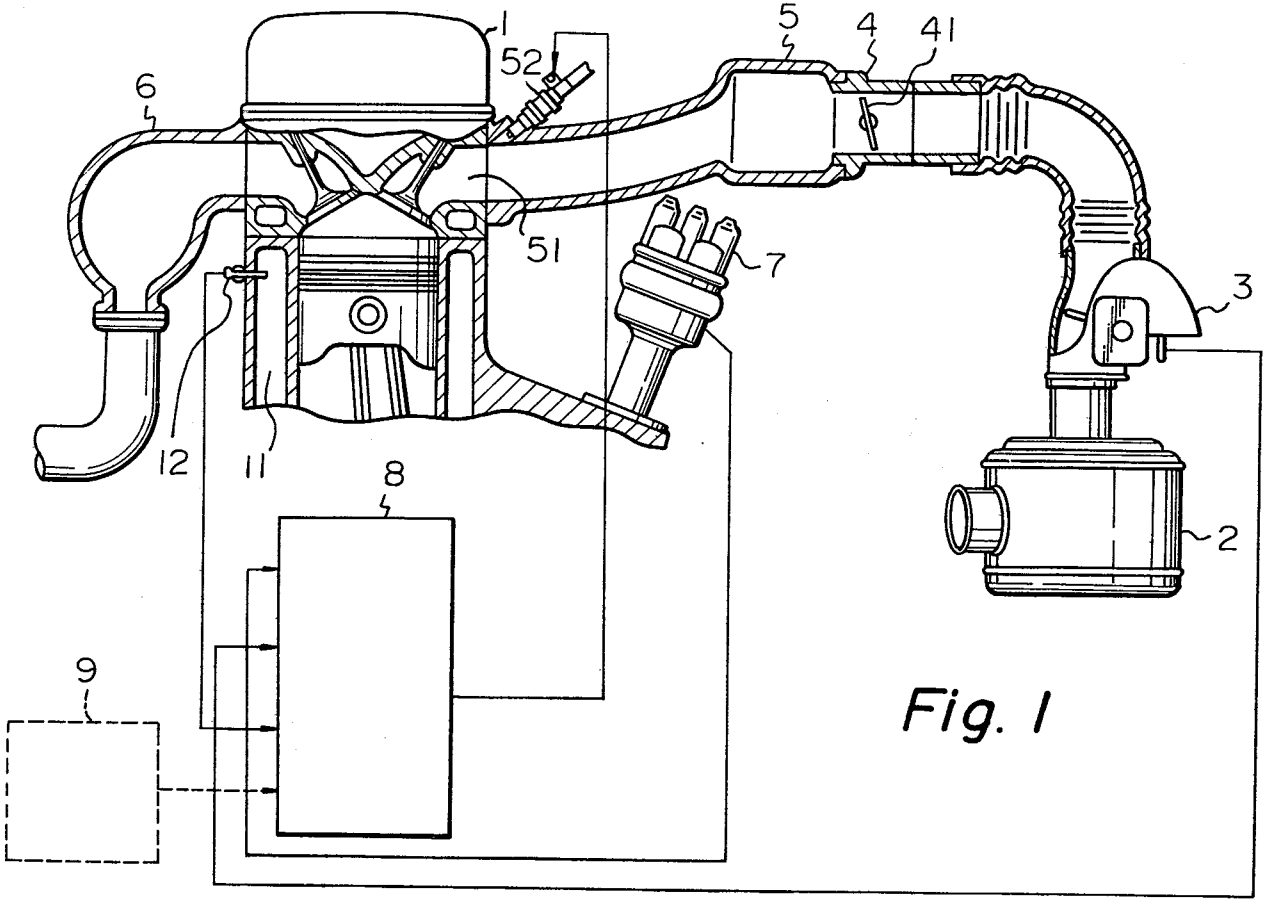
FIG. 1 illustrates an apparatus for controlling the fuel injection in an internal combustion engine according to an embodiment of the present invention.

An apparatus for controlling the fuel injection in an internal combustion engine according to an embodiment of the present invention is illustrated in FIG. 1. The structure of the electronic control device in the apparatus of FIG. 1 is illustrated in FIG. 2.

The apparatus of FIG. 1 comprises: a six-cylinder, internal combustion engine 1; an air cleaner 2, an air flow sensor 3 for detecting the amount of the intake air flow; a throttle body 4 including a throttle valve 41; an air intake manifold 5; an ignition distributor 7, including a rotation sensor for detecting the rotational speed of the engine 1, operating to successively supply ignition energy to the cylinders; and fuel injectors 52 arranged in the vicinity of the intake port 51. The apparatus of FIG. 1 also comprises: an exhaust manifold 6, a water temperature sensor 12 for detecting the temperature of the coolant water 11 for the engine 1, a clutch switch 9, and an electronic control device 8 which receives the signals from the intake air flow sensor 3, the rotation sensor of the ignition distributor 7, the water temperature sensor 12, and the clutch switch 9 and which produces the signal for controlling the operation of the fuel injector 52.

Figure 2:
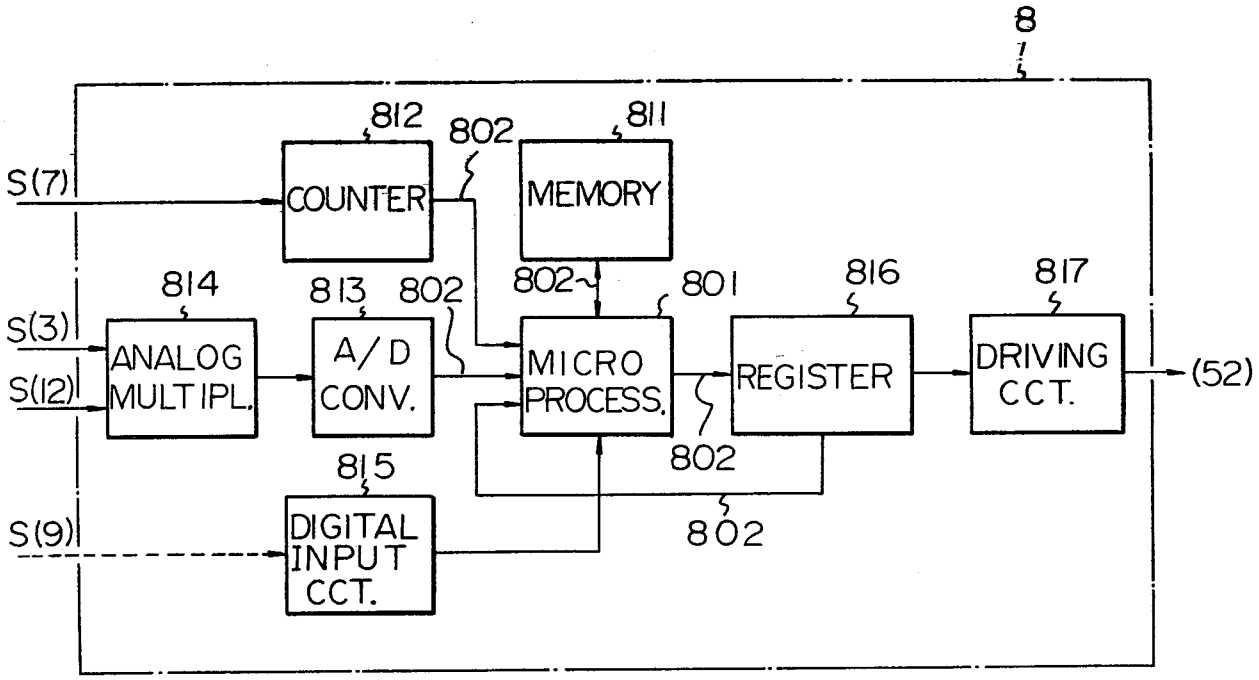
FIG. 2 illustrates the structure of the electronic control device in the apparatus of FIG. 1.

The electronic control device 8 illustrated in FIG. 2 comprises a microprocessor 801, a memory unit 811, a counter unit 812, an analog-to-digital converter 813, an analog multiplexer 814, a digital input circuit 815, a register 816, and a driving circuit 817. The memory unit 811, the counter unit 812, the analog-to-digital converter 813, and the register 816 are connected with the microprocessor 801 through common bus 802.

The counter unit 812 receives the signal S(7) from the rotation sensor of the ignition distributor 7. The analog multiplexer 814 receives the signal S(3) from the air flow sensor 3 and the signal S(12) from the water temperature sensor 12. The digital input circuit 815 receives the signal S(9) from the clutch switch 9.

The memory unit 811 stores a program for controlling the engine. The counter unit 812 includes a binary counter and determines the rotational speed of the engine.

The microprocessor 801 calculates the fuel injection amount on the basis of the control program supplied from the memory unit 811, using the rotational speed signal from the counter unit 812 and the of intake air signal from the analog-to-digital converter 813 as main data, and the water temperature signal from the analog-to-digital converter 813 as correction data.

The microprocessor 801 produces the output signal for the fuel injection amount in the form of a digital signal representing fuel injection duration. Since the fuel pressure at the fuel injection nozzle is constant, the fuel injection amount can be represented by the fuel injection duration.

The register 816 receives the digital signal from the microprocessor 801 and converts this digital signal into the output pulse signal of fuel injection duration. The driving circuit 817 receives the pulse signal from the register 816 and amplifies this pulse signal to produce the output signal which is supplied to the fuel injector 52.

Figure 3A:
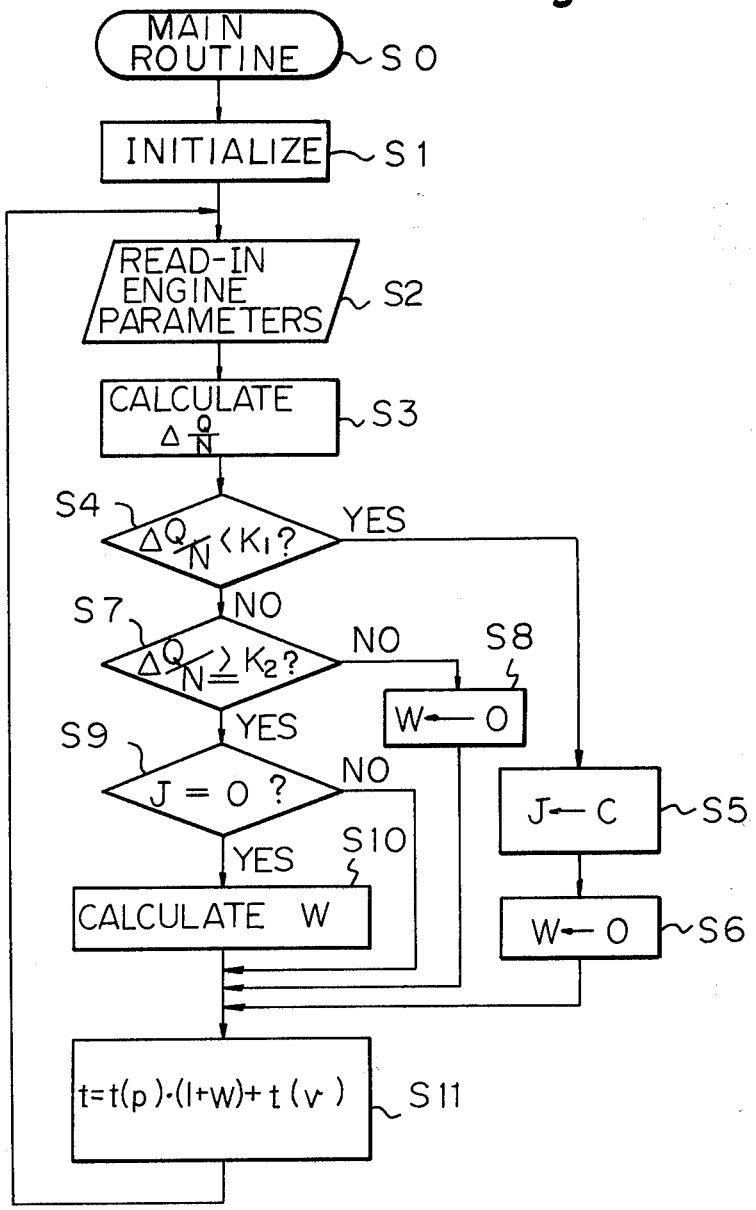
FIGS. 3A, 3B, and 3C illustrate a flow chart representing the control process carried out in the apparatus of FIG. 1 according to an embodiment of the present invention.
Figure 3C:
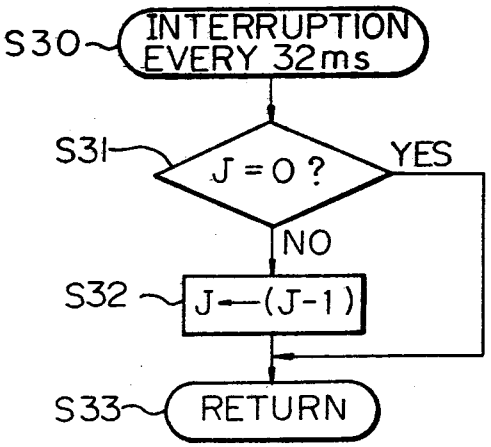
Figure 3B:
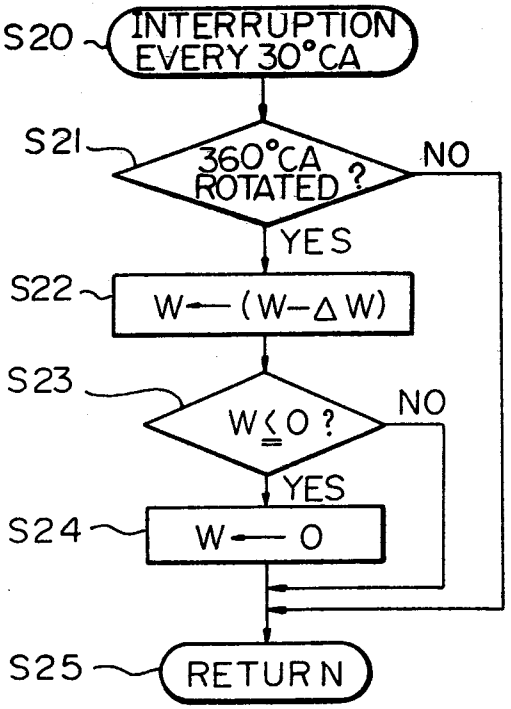

An example of the flow chart representing the control process carried out by the electronic control device 8 is illustrated in FIGS. 3A, 3B, and 3C. The main routine is illustrated in FIG. 3A, and the interruption routines are illustrated in FIGS. 3B and 3C. The main routine is started in Step S0, the initial values are established in Step S1, and the engine parameters are read-in in Step S2. The rate ($\Delta Q/N$) of change of the ratio ($Q/N$) between the intake air amount ($Q$) and the rotation at speed ($N$) is calculated in Step S3. The ratio ($Q/N$) is used as a detected variable in the present invention. The ratio ($Q/N$) is calculated every 32 ms. Hence, the ratio ($\Delta Q/N$) is calculated as:

$$\Delta(Q/N)=(Q/N)_i-(Q/N)_{i-1} \quad (1)$$

In equation (1), $(Q/N)_i$ represents the value at the present timing, while $(Q/N)_{i-1}$ represent the value at the previous timing.

The decision as to whether the present state is the gear change state is carried out in Step S4 in the form of the criterion:

$$\Delta(Q/N)<K_1 \quad (2)$$

In inequality (2), $K_1$ is a negative value level indicating the gear change state. During gear change operations, the gears are disengaged and hence the rotational speed $N$ of the engine is increased, whereby the ratio $Q/N$ is reduced. Accordingly, the rate ($\Delta Q/N$) is of a negative value. The level $K_1$ is obtained from the results of experiments using the engine in question.

When the decision in Step S4 is YES, i.e., the present state is the gear change state, the process proceeds to Step S5. When the decision in Step S4 is NO, i.e., the present state is not the gear change status, the process proceeds to Step S7.

In Step S5, the time defining count value ($J$) is set to the predetermined value for prohibiting the fuel increase. In Step S6, the fuel increase rate ($W$) is set to zero.

The decision as to whether the present state is the acceleration state is carried out in Step S7 in the form of the criterion:

$$\Delta(Q/N)\geqq K_2 \quad (3)$$

In inequality (3), $K_2$ is the level indicating the acceleration state. This $K_2$ is called "the triggering level of the fuel increase rate ($W$)".

When the decision in Step S7 is NO, i.e., the present state is not the acceleration state, the process proceeds to Step S8. When the decision in Step S7 is Yes, i.e., the present state is the acceleration state, the process proceeds to Step S9. In Step S8, the rate ($W$) is set to zero.

The decision as to whether the time defining count value ($J$) is zero is carried out in Step S9. When the decision in Step S9 is NO, the process proceeds to Step S11 and the rate ($W$) in the fuel injection duration calculation equation of Step S11 is set to zero.

When the decision in Step S9 is YES, the process proceeds to Step S10. In Step S10, the rate ($W$) is calculated on the basis of a predetermined parameter of engine operation, such as coolant water temperature. The coolant water temperature is used as a detected predetermined variable. A map indicating the relationship between the rate ($W$) and the engine operation parameter is stored in the memory unit 811. This map is used for the calculation of the rate ($W$) in Step S10.

In Step S11, the fuel injection duration ($t$) is calculated using the equation:

$$t=t(p)\cdot(1+W)+t(v) \quad (4)$$

In equation (4), $t(v)$ is the invalid fuel injection duration, and $t(p)$ is the basic fuel injection duration given by the equation:

$$t(p)=a_1\cdot(Q/N) \quad (5)$$

In equation (5), $a_1$ is a predetermined constant. Thus the process returns to Step S2 from Step S11, and the main routine from Step S2 to Step 11 is repeated.

The interruption routine illustrated in FIG. 3B is carried out once for every 30° crank angle, that is, every rotational angle 30° of the crankshaft. The interruption is started in Step S20. The decision as to whether the crankshaft has rotated 360° after one injection of the fuel is carried out in Step S21. When the decision is NO, the process proceeds to Step S25. When the decision is YES, the process proceeds to Step S22.

In Step S22, the fuel increase rate ($W$) is corrected by subtracting ($W$-$\Delta W$) the fuel increase reduction rate ($\Delta W$) from the fuel increase rate ($W$). In Step S23, the decision as to the following inequality is carried out:

$$W\leqq O \quad (6)$$

When the decision is NO, the process proceeds to Step S25. When the decision is YES, the process proceeds to Step S24. In Step S24, the rate ($W$) is set to zero. The return of the interruption is carried out in Step S25.

Thus, the fuel increase rate ($W$) is reduced by $\Delta W$ at every fuel injection.

The interruption routine illustrated in FIG. 3C is carried out once every 32 ms. The interruption is started in Step S30 by the signal supplied once every 32 ms from a timing device. In step S31, the decision as to whether the time defining count value ($J$) is zero is carried out. When the decision is YES, the process proceeds to Step S33. When the decision is NO, the process proceeds to Step S32.

In Step S32, the count value ($J$) is reduced by one. The return of the interruption is carried out in Step S33.

Thus, the count value ($J$) is stepwisely reduced until it reaches zero. This means that if the count value ($J$) is set to C in step S5 of the main routine, the interruption routine of FIG. 3C stepwisely reduces the count value ($J$) until it reaches zero. The time T is ms for this reduction to zero of the count value ($J$) is as follows:

$$T=32C \quad (7)$$

Accordingly, if the decision of Step S4 in the main routine is YES, that is, the present state is the gear change state, the interruption routine of FIG. 3C prohibits the fuel increase during this period T.

Figure 4:
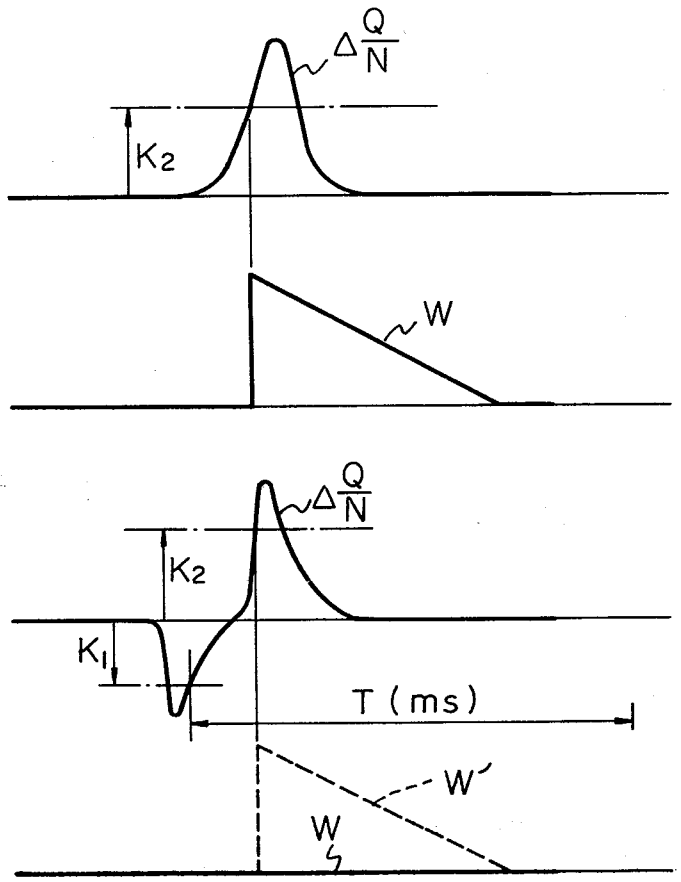
FIG. 4 illustrates the changes with time of Q/N and the fuel increase rate (W) corresponding to the flow chart of FIGS. 3A, 3B, and 3C.

The changes with time of $\Delta Q/N$ and $W$ during engine acceleration are illustrated in FIG. 4,(1) and FIG. 4,(2), respectively. The changes during gear change operations are illustrated in FIG. 4,(3) and FIG. 4,(4), respectively.

As illustrated in FIG. 4,(1) and (2), during ordinary engine operation, the fuel increase rate (W) is increased according to the increase of $\Delta(Q/N)$ above the level $K_2$. As illustrated in FIG. 4,(3) and FIG. 4,(4), during gear change operations, the increase of the fuel increase rate (W) is prohibited and, hence the rate (W) is maintained at zero (FIG. 4,(4)) within the period T indicated in FIG. 4,(3). Without this prohibition, the rate (W) would be increased as indicated by the broken line (W') in FIG. 4,(4).

Figure 5:
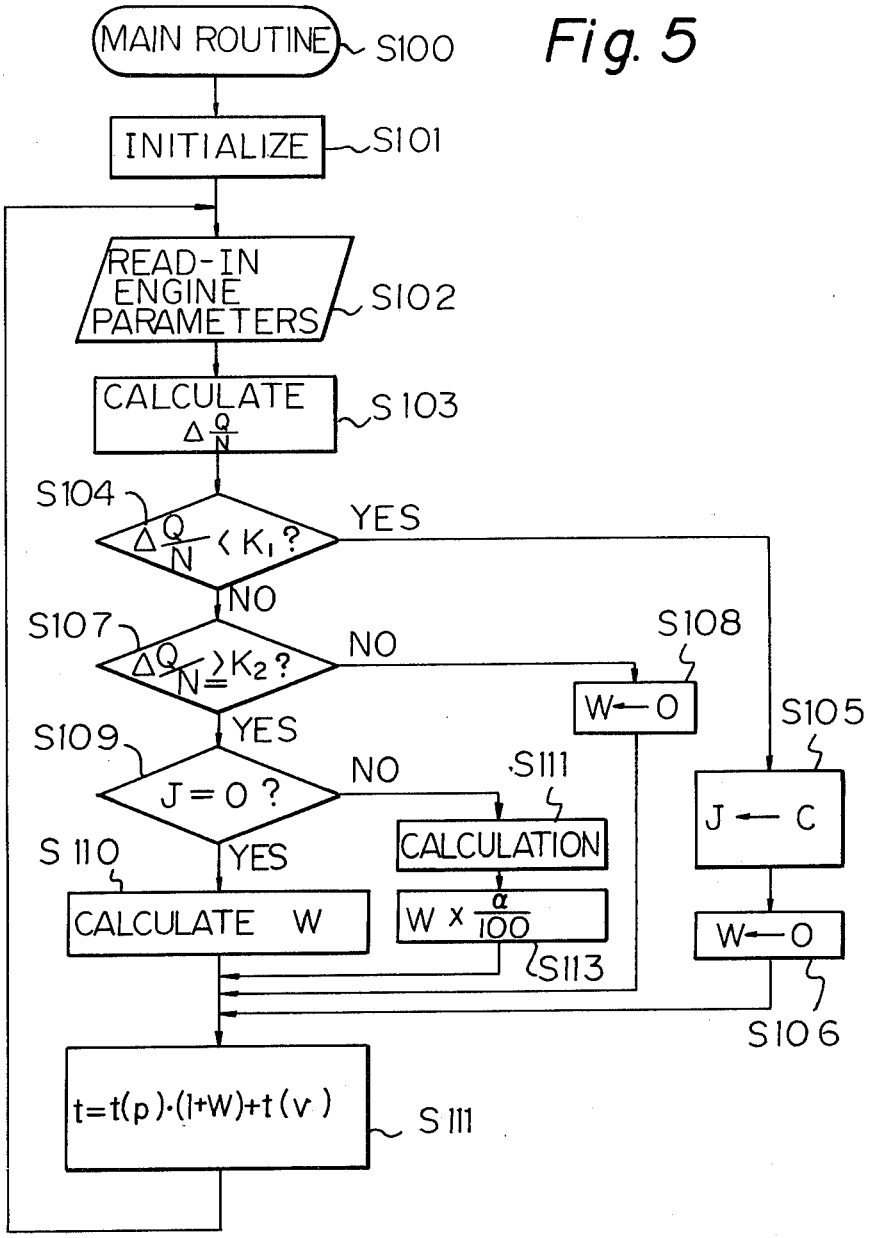
FIG. 5 illustrates a flow chart representing the control process carried out in the apparatus of FIG. 1 according to another embodiment of the present invention.
Figure 6:
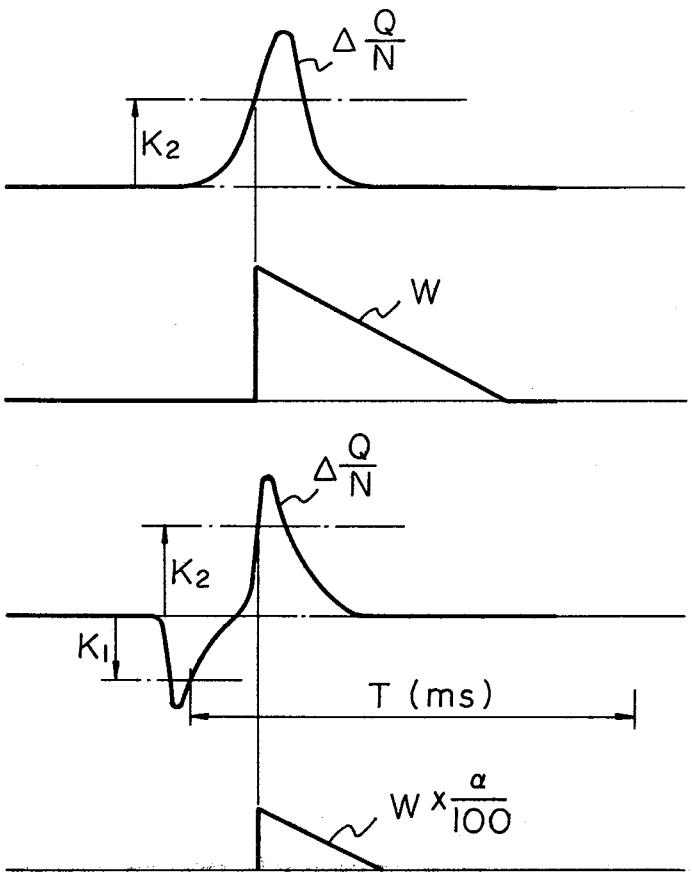
FIG. 6 illustrates the changes with time of Q/N and W corresponding to the flow chart of FIGS. 5A, 3B, and 3C.

A modified embodiment of the present invention is illustrated in FIGS. 5 and 6. In the above embodiment of FIGS. 2, 3, and 4, the fuel increase is prohibited during gear change operations. In the embodiment of FIGS. 5 and 6, the fuel increase rate (W) assumes a different value during gear change operations.

FIG. 5 illustrates the flow chart representing the main routine of the control process carried out by this modified embodiment. The interruption routines combined with the main routine of FIG. 5 are the same as the interruption routines illustrated in FIGS. 3B and 3C.

Steps S100 through S111 are the same as Steps S0 through S11 of FIG. 3A, respectively. When the decision of Step S109 is NO, the process proceeds to Step S112 and then to Step S113.

In Step S112, the fuel increase rate (W) is calculated on the basis of a predetermined parameter of engine operation. In Step S113, the thus calculated rate (W) by is multiplied by a predetermined constant $\alpha/100$. Such multiplication of the fuel increase rate (W) is advantageous from the viewpoint of preventing the deterioration of engine driveability due to a shortage of injected fuel during acceleration after a gear change operation.

The changes with time of $\Delta Q/N$ and W during engine acceleration are illustrated in FIG. 6,(1) and FIG. 6,(2), respectively. The changes during gear change operations and subsequent acceleration are illustrated in FIG. 6(3) and FIG. 6(4), respectively.

As illustrated in FIG. 6(3) and FIG. 6(4), if a gear change operation and subsequent acceleration are carried out, the injected fuel is increased at the rate "$W \times (\alpha/100)$" during the period T.

Although the preferred embodiments of the present invention have been described hereinbefore, various modifications or alterations are possible within the scope of the present invention.

For example, the electronic control device in the above embodiment can be constructed with microcomputers, analog computers, and other various form of electronic devices.

Also, the decision as to whether the present state is the gear change state can be carried out by using the signal of a clutch switch which represents the "OFF" action of the clutch. The clutch switch 9 (FIG. 2) is attached to the clutch of the automobile transmission. The signal S(9) which represents the "OFF" action of the clutch is supplied to the digital input circuit 815. In this case, the decision as to whether the clutch is "OFF" replaces the decision as to whether $\Delta Q/N < K_1$ in Step S4 of the main routine illustrated in FIG. 3A.

We claim:

1. An apparatus for controlling the fuel injection in an internal combustion engine, comprising: an air flow sensor; a rotation sensor; a collant water temperature sensor; a fuel injection nozzle; and an electronic control device for receiving the signals from said intake air sensor, said rotation sensor, and said coolant water temperature sensor, for calculating the fuel injection duration on the basis of said received signals, and for producing the signal to control said fuel injection nozzle;

the ratio (Q/N) between the intake air amount (Q) and the rotational speed (N) being used as the signal for triggering the increase, wherein said fuel increase is prohibited or modified during gear change operations of the automobile driven by the engine.

2. A method for controlling the fuel injection in an internal combustion engine comprising the steps of:

reading in engine parameters including at least engine rotational speed and intake air amount;

calculating the rate ($\Delta Q/N$) of change of ratio between intake air amount and engine rotational speed by using said read-in engine parameters;

deciding first whether or not the present state is the gear change state by deciding whether or not the rate ($\Delta Q/N$) is less than a predetermined value;

deciding second whether or not the present state is the acceleration state using said read-in engine parameters when the result of said first decision is negative;

increasing the amount of fuel injection when the result of said second decision is affirmative; and prohibiting the increase of the amount of fuel injection when the result of said first decision is negative.

3. A fuel injection apparatus for an internal combustion engine comprising:

a sensor means for sensing engine parameters including at least an air flow sensor and an RPM sensor;

a fuel injection nozzle means for injecting the fuel; and an electronic control means for receiving the signals from said sensor means, for calculating the fuel injection duration on the basis of said received signals, and for producing the signal to control said fuel injection nozzle means;

said electronic control means being adapted to calculate the rate ($\Delta Q/N$) of change of ratio between intake air amount and engine rotational speed by using the signals from said sensor means, deciding first whether or not the present state is the gear change state by deciding whether or not the rate ($\Delta Q/N$) is less than a predetermined value, and deciding second whether or not the present state is the acceleration state using the signals from said sensor means when the result of said first decision is negative, for increasing the amount of fuel injection when the result of said second decision is affirmative, and prohibiting the increase of the amount of fuel injection when the result of said first decision is negative.

4. An apparatus as defined in claim 1, wherein the fuel increase rate, determined by the coolant water temperature, is calculated by said electronic control device.

5. A method as defined in claim 2, wherein said second decision is carried out by deciding whether or not the rate ($\Delta Q/N$) is greater than a predetermined value.

* * * * *